US008777570B1

(12) United States Patent
Liang

(10) Patent No.: US 8,777,570 B1
(45) Date of Patent: Jul. 15, 2014

(54) TURBINE VANE WITH FILM COOLING SLOTS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 707 days.

(21) Appl. No.: 12/757,226

(22) Filed: Apr. 9, 2010

(51) Int. Cl.
*F01D 5/08* (2006.01)

(52) U.S. Cl.
USPC ..... 416/97 R; 416/193 A; 415/115

(58) Field of Classification Search
USPC ..... 415/115; 416/95, 96 R, 96 A, 97 R, 97 A, 416/193 A
See application file for complete search history.

(56) References Cited

U.S. PATENT DOCUMENTS

| | | | | |
|---|---|---|---|---|
| 4,664,597 | A * | 5/1987 | Auxier et al. | 416/97 R |
| 4,693,667 | A * | 9/1987 | Lenz et al. | 415/115 |
| 6,247,896 | B1 * | 6/2001 | Auxier et al. | 416/97 R |
| 7,137,776 | B2 * | 11/2006 | Draper et al. | 415/115 |

* cited by examiner

*Primary Examiner* — Igor Kershteyn
(74) *Attorney, Agent, or Firm* — John Ryznic

(57) ABSTRACT

A stator vane with endwalls having film cooling diffusion slots that open onto the hot gas surface. Each diffusion slot is formed as a row of one or more separated diffusion slots each having a serpentine flow channel and one or more metering inlet holes to supply spent cooling air from an impingement chamber to the diffusion slots. The metering inlet holes meter the flow of cooling air into the serpentine channels, the serpentine channels provide convection cooling for the endwalls, and the diffusion slots diffuse the cooling air into a layer of film cooling air onto the hot gas surface of the endwalls.

9 Claims, 3 Drawing Sheets

Section A-A

TURBINE VANE WITH FILM COOLING SLOTS

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a stator vane with coating resistant film cooling slots.

2. Description of the Related Art Including Information Disclosed Under 37 CFR 1.97 and 1.98

In a gas turbine engine, such as an industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream. Complex internal cooling circuits are formed within the airfoils to provide higher cooling effectiveness using a minimal amount of cooling air flow. Certain surfaces of the blades and vanes are exposed to higher gas stream temperatures or areas are not cooled as much such that hot spots are generated on the airfoils or platforms such that erosion damage occurs.

In a prior art turbine stator vane such as that shown in FIG. 1, backside impingement cooling in series with multiple rows of film cooling holes 14 is used to provide cooling for a high temperature first stage large frame heavy-duty industrial gas turbine stator vane endwalls 12 and 13 and the airfoil section 11. Individual compartments are used on the backside of the inner diameter (ID) and outer diameter (OD) endwalls for a better control of the cooling flow and pressure distribution. Impingement cooling holes 15 formed within an impingement plate provides for backside impingement cooling of the ID and OD endwalls. The impingement cooling air then flows out through the film cooling holes onto the hot surface of the endwalls. However, for a fixed impingement pressure across the impingement holes or post impingement cooling air pressure, each individual compartment will still be exposed to a large main stream gas pressure to cooling air pressure variation. In other words, the same pressure will be found on the inner surface around the endwalls while the external pressure on the endwall can vary. Also, each impingement compartment has to be designed with a post impingement pressure higher than the maximum main stream hot gas pressure in order to achieve a good BFM (back flow margin, to prevent the hot gas stream from flowing into the film cooling holes). As a result, an over-pressure for the cooling air is produced at locations on the endwall where the lower main stream hot gas pressure is found. This over-pressure issue becomes more profound in the aft portion of the vane suction side where the endwall experiences the maximum main stream variation as well as a maximum cooling air to hot gas pressure ration. Metering down the cooling pressure through the impingement holes in order to obtain the maximum film cooling on the endwall surface may result in a hot gas ingestion problem when some of the impingement holes become plugged by dirt or debris. A result of this large compartment cooling design is that it becomes difficult to achieve a streamwise and circumferential wise cooling flow control for the endwall with a large external hot gas temperature and pressure variation. Also, a single impingement cooling process with a large impingement cavity to cover a large endwall region is not the best method for utilizing the cooling air. A result of this maldistribution of the cooling flow yields a low convection cooling effectiveness.

BACKGROUND OF THE INVENTION

A stator vane having endwalls each with a number of rows of film diffusion slots that open onto the hot surface of each endwall. Each diffusion slot is formed with one or more separated diffusion slots each having a serpentine flow channel and one or more metering inlet holes to supply cooling air to the diffusion slot. The inlet metering holes are connected to the impingement chambers formed over the endwalls so that the spent impingement cooling air from the impingement chamber is supplied to the inlet metering holes of the diffusion slots. The combination of metering cooling air, impingement cooling, serpentine flow and diffusion provide for a high rate of cooling with a low flow rate of cooling air.

Each serpentine channel and diffusion slot can be formed with one or more separated serpentine channels and diffusion slots to provide for different flow and pressure requirements depending upon the external hot gas pressure and temperature profiles. Separation ribs are used within the serpentine channels and the diffusion slots to form separated slots.

DETAILED DESCRIPTION OF THE INVENTION

Figure 1:
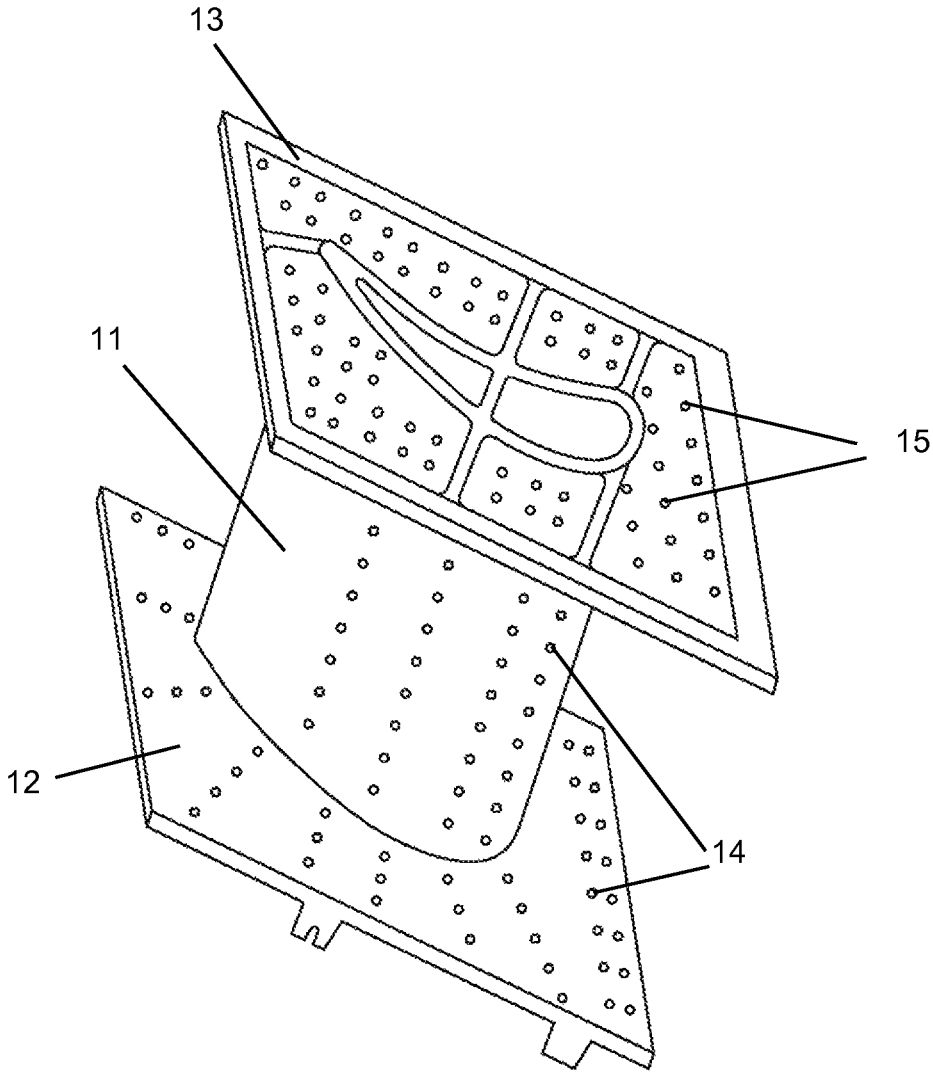
Fig 1 Prior Art
FIG. 1 shows an isometric view of a prior art turbine stator vane with endwall film cooling holes.
Figure 2:
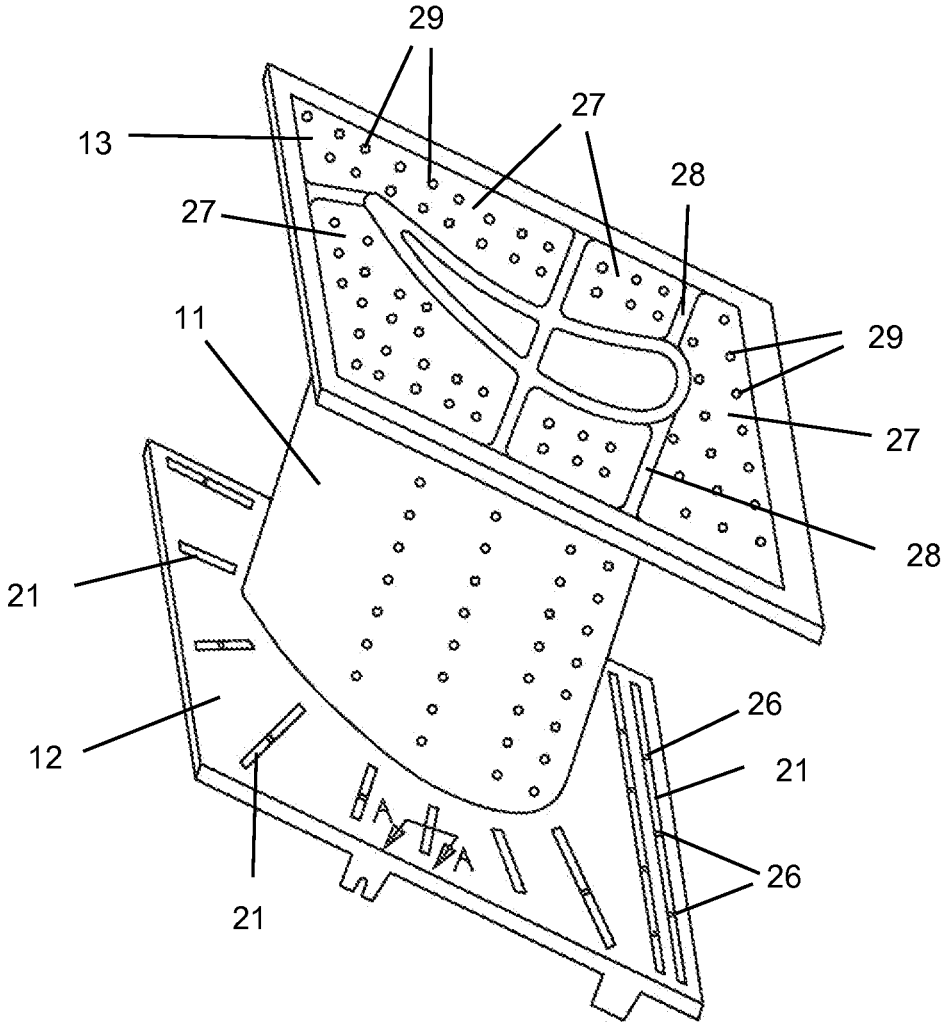
FIG. 2 is an isometric view of the turbine stator vane of the present invention with endwall film cooling slots.

A turbine stator vane for a gas turbine engine, especially for a large frame heavy duty industrial gas engine, is shown in FIG. 2 and includes an airfoil 11 extending between an inner diameter (ID) endwall 12 and an outer diameter (OD) endwall 13. instead of using individual film cooling holes as in the FIG. 1 prior art vane, the present invention uses rows of film cooling slots 21 that open onto the endwall hot surfaces like the rows of prior art film cooling holes did. The slots 21 are single slots of slots with ribs 26 that separate adjacent slots and the cooling air passages that connect the slots so that pressure and flow variations can be designed for.

FIG. 2 shows the vane with the OD endwall having 13 having separate impingement compartments 27 separated by ribs 28. An impingement plate with impingement cooling holes 29 is secured over the ID and OD endwalls and provides impingement cooling on the backside surface of both endwalls 12 and 13. Instead of the film cooling holes of the FIG. 1 prior art vane endwalls, the present invention uses rows of film cooling slots 21 to discharge the spent impingement cooling air from the backside surfaces of both endwalls. The rows of film slots 21 are formed as straight slots but do not have to be straight. Also, most of the film slots 21 are partitioned by one or more ribs 26 so that the cooling air flow and pressure through each partitioned section can be regulated individually.

Figure 3:
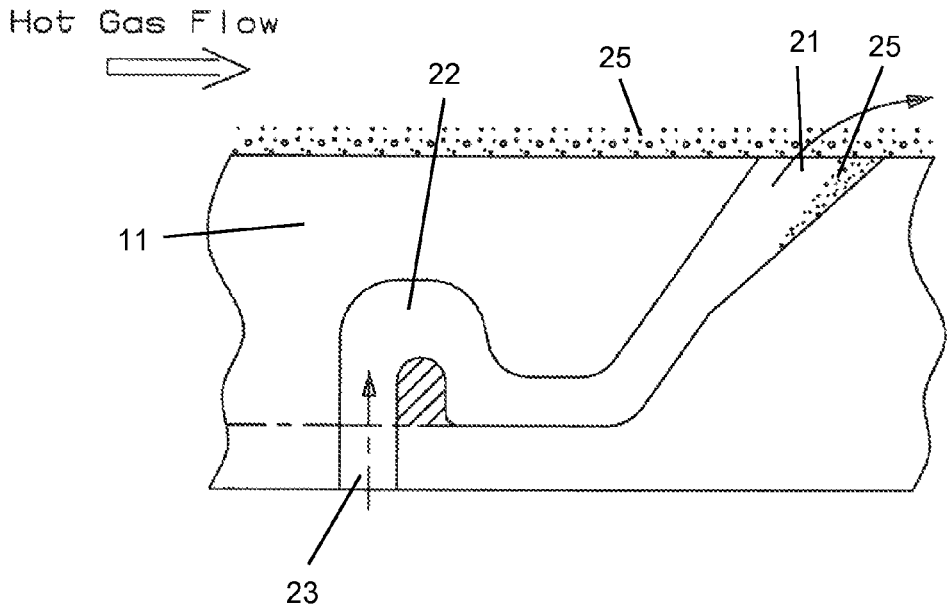
FIG. 3 is a cross section view of a film cooling slot through the line A-A in FIG. 2.
Figure 4:
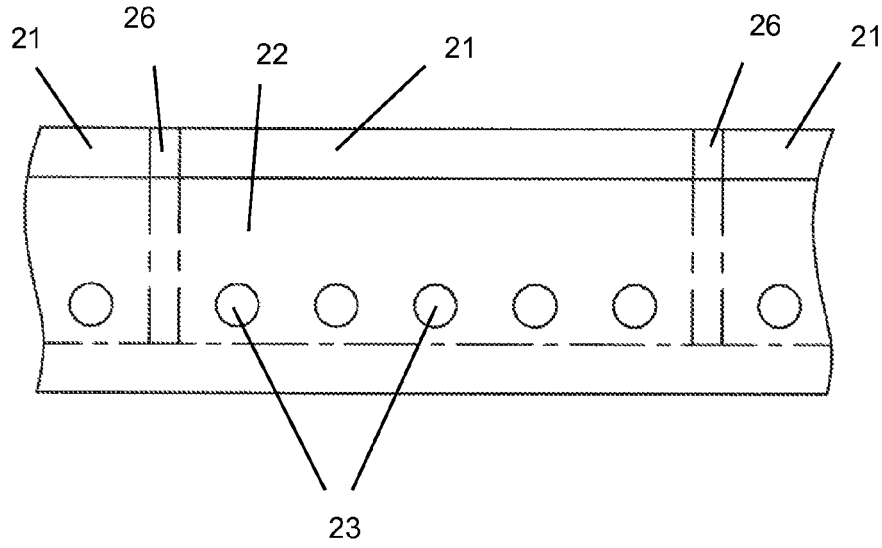
FIG. 4 is a top view of a film cooling slot of the present invention.

FIG. 3 shows a cross section side view of one of these film slots as represented by the line A-A in FIG. 2. The ID endwall 11 includes a hot surface with a TBC 25 applied over it. The film slot includes one or more inlet metering holes 23 that are connected to the spent impingement cooling chamber formed between the endwall and the impingement plate. Several metering holes for each film slot 21 are preferable. Downstream from the inlet metering holes 23 is a continuous cooling air channel having a wavy or serpentine flow shape with an up passage leading into a down passage and then into a diffusion slot that opens into the hot surface of the endwall. The serpentine flow channel can be divided into separate compartments by one or more of the ribs 26 which would be formed downstream from the inlet metering holes 22. As seen in FIG. 3, the TBC 25 can be covered over a portion of the film slot 21 on the hot gas stream downstream side. FIG. 4 shows a view of the film slot 21 from the bottom with a film slot 21 being separated into three compartments by two ribs 26. The inlet metering holes 23 open into the three compartments each leading into a separate film slot 23 that opens onto the hot surface of the endwall.

The film cooling slots 23 of the present invention provide multiple metering and impingement cooling plus diffusion of the cooling air as well as convection cooling as the cooling air flows through the serpentine passage from the inlet metering holes to the film diffusion slot 23. The multiple metering and impingement diffusion slots are constructed in small compartments with individual compartments sized and shaped based on the airfoil gas side pressure distribution in both the streamwise and circumferential directions. Also, each individual compartment can be designed based on the endwall local external heat load to achieve a desired local metal temperature. The individual small compartments are constructed in a straight line array along the endwall against the mainstream hot gas flow. This design will maximize the use of cooling air for a given vane endwall inlet gas temperature and pressure profile.

The multiple compartments with multiple metering and serpentine flow cooling channels followed by diffusion slots is used for backside convection cooling and flow metering purposes. The spent impingement cooling air is metered in each individual cooling compartment to allow for the cooling air to serpentine through the inlet section of the diffusion slot and then diffused into the continuous film slots in which the cooling air then has a reduced exit momentum. Coolant penetration into the gas oath is thus minimized yielding a good buildup of the coolant sub-boundary layer next to the endwall hot gas surface which leads to better film coverage in the streamwise and circumferential directions on the endwall. The combined effect of the multiple hole impingement cooling plus serpentine and diffusion slots and film cooling yields a very high cooling effectiveness and therefore achieves a uniform wall temperature for the endwalls. Also, the metering holes are located upstream of the serpentine and diffusion channels which allows for the TBC to be coated within the metering holes when applied over the hot surface of the endwall. Since the continuous diffusion slot is large enough, it can be designed to accommodate the buildup of the TBC within the diffusion slots.

In operation, the cooling air is supplied by the endwall cooling supply cavities located on the backsides of the endwalls. Cooling air is then impinged onto the backside through impingement holes formed in the impingement plate and into the impingement chamber. The amount of cooling air for each individual impingement chamber is sized based on the local gas side heat load and pressure which therefore regulates the local cooling performance and metal temperature. The spent impingement cooling air is then metered through the serpentine flow channels within the endwalls. The spent cooling air is then injected into a continuous diffusion slot. The spent cooling air is then discharged onto the endwall hot surface to provide a precise located film layer. Optimum cooling flow utilization is achieved with this endwall cooling design to maximize the usage of cooling air for a given vane inlet gas temperature and pressure profile.

I claim the following:

1. An air cooled stator vane for a gas turbine engine comprising:

an airfoil extending between an inner diameter endwall and an outer diameter endwall;

an impingement cover plate secured to a backside of each endwall to form an impingement chamber for backside cooling of the endwall;

a plurality of impingement cooling holes formed within the two cover plates;

a diffusion slot opening onto a hot surface of each of the two endwalls;

the diffusion slot having a serpentine flow channel upstream of the diffusion slot and a metering inlet hole upstream of the serpentine flow channel;

the metering inlet hole is connected to the impingement chamber to supply cooling air to the diffusion slot;

the diffusion slot is formed into a row of diffusion slots and serpentine flow channels each separated by a rib; and, each separated serpentine flow channel and diffusion slot having a metering inlet hole connected to supply cooling air to the diffusion slot.

2. The air cooled stator vane of claim 1, and further comprising:

a plurality of inlet metering holes open into the serpentine flow channel.

3. The air cooled stator vane of claim 1, and further comprising:

a plurality of rows of diffusion slots spaced around the endwalls.

4. The air cooled stator vane of claim 1, and further comprising:

the diffusion slot has an upstream side wall with no diffusion and a downstream side wall with diffusion.

5. An air cooled stator vane for a gas turbine engine comprising:

an airfoil extending between an inner diameter endwall and an outer diameter endwall;

an impingement cover plate secured to a backside of each endwall to form an impingement chamber for backside cooling of the endwall;

a plurality of impingement cooling holes formed within the two cover plates;

a diffusion slot opening onto a hot surface of each of the two endwalls;

the diffusion slot having a serpentine flow channel upstream of the diffusion slot and a metering inlet hole upstream of the serpentine flow channel;

the metering inlet hole is connected to the impingement chamber to supply cooling air to the diffusion slot;

the metering inlet hole is directed to discharge impingement cooling air to a backside surface of the endwall; and, the serpentine flow channel is substantially perpendicular to a plane of the endwall.

6. The air cooled stator vane of claim 5, and further comprising:

a plurality of inlet metering holes open into the serpentine flow channel.

7. The air cooled stator vane of claim 5, and further comprising:

the diffusion slot is formed into a row of diffusion slots and serpentine flow channels each separated by a rib; and, each separated serpentine flow channel and diffusion slot having a metering inlet hole connected to supply cooling air to the diffusion slot.

8. The air cooled stator vane of claim 5, and further comprising:

a plurality of rows of diffusion slots spaced around the endwalls.

9. The air cooled stator vane of claim 5, and further comprising:

the diffusion slot has an upstream side wall with no diffusion and a downstream side wall with diffusion.

* * * * *